US008033583B2

(12) United States Patent
Chang

(10) Patent No.: US 8,033,583 B2
(45) Date of Patent: Oct. 11, 2011

(54) ELECTRIC LOCK DEVICE

(75) Inventor: Chih Chung Chang, Taipei Hsien (TW)

(73) Assignee: Gianni Industries Inc., Taipei Hsien (TW)

( * ) Notice: Subject to any disclaimer, the term of this patent is extended or adjusted under 35 U.S.C. 154(b) by 775 days.

(21) Appl. No.: 12/079,145

(22) Filed: Mar. 25, 2008

(65) Prior Publication Data

US 2009/0241618 A1 Oct. 1, 2009

(51) Int. Cl.
*E05C 1/06* (2006.01)
*E05B 47/00* (2006.01)

(52) U.S. Cl. ..... 292/144; 292/150; 292/341.15; 70/277; 70/278.7; 70/283

(58) Field of Classification Search ..... 292/144, 292/150, 341.15, 341.16; 70/277, 278.7, 70/279.1, 283
See application file for complete search history.

(56) References Cited

U.S. PATENT DOCUMENTS

| | | | | |
|---|---|---|---|---|
| 4,579,376 | A * | 4/1986 | Charlton | 292/144 |
| 4,984,835 | A * | 1/1991 | Vadacchino et al. | 292/341.16 |
| 5,127,691 | A * | 7/1992 | Herron et al. | 292/341.16 |
| 5,531,086 | A | 7/1996 | Bryant | 70/279 |
| 5,934,720 | A | 8/1999 | Karalius | 292/341.16 |
| 7,144,053 | B2 * | 12/2006 | Bashford | 292/341.16 |
| 7,246,827 | B2 * | 7/2007 | Geringer et al. | 292/144 |
| 7,469,564 | B1 * | 12/2008 | Shaw | 70/283 |
| 7,540,542 | B2 * | 6/2009 | Geringer et al. | 292/341.16 |

* cited by examiner

*Primary Examiner* — Carlos Lugo
(74) *Attorney, Agent, or Firm* — Charles E. Baxley

(57) ABSTRACT

A lock device includes a tongue slidably engaged with a housing and extendible out of the housing, an anchoring device slidably disposed in the housing and having two anchoring members for selectively aligning with the tongue and having a compartment formed between the anchoring members, and a moving device for moving the anchoring device relative to the housing to selectively align either of the anchoring members with the tongue and for preventing the tongue from being engaged into the compartment of the anchoring device. The moving device includes an electromagnetic mechanism coupled to the anchoring device for moving the anchoring device relative to the housing.

7 Claims, 8 Drawing Sheets

ELECTRIC LOCK DEVICE

BACKGROUND OF THE INVENTION

1. Field of the Invention

The present invention relates to a lock device, and more particularly to an electric and mechanical lock device including a deadbolt or tongue lockable with an electromagnetic mechanism which is adjustable and operatable when the electromagnetic mechanism is either switched on or switched off.

2. Description of the Prior Art

Typical electromagnetic lock devices comprise a core slidably disposed or engaged in a coil and actuatable or movable or operatable with the coil to actuate the core to operate a deadbolt or tongue and to lock or unlock a door or window.

For example, U.S. Pat. No. 5,531,086 to Bryant discloses one of the typical keyless entry deadbolt lock comprising a deadbolt or tongue indirectly coupled to an electromagnetic mechanism with a connecting rod for allowing the deadbolt or tongue to be actuated or operated by the electromagnetic mechanism.

However, the deadbolt or tongue may be disengaged or unlocked from the keeper of the door jamb only when the electromagnetic mechanism is operated or energized, but may not be unlocked when the electromagnetic mechanism is not operated or is not energized.

U.S. Pat. No. 5,934,720 to Karalius discloses another typical low profile release mechanism for electric door strike also comprising a deadbolt or tongue directly coupled to a core of an electromagnetic mechanism for allowing the deadbolt or tongue to be actuated or operated by the core and an actuating coil of the electromagnetic mechanism.

However, the deadbolt or tongue also may be disengaged or unlocked from the keeper of the door jamb only when the electromagnetic mechanism is operated or energized, but may not be unlocked when the electromagnetic mechanism is not operated or is not energized.

The present invention has arisen to mitigate and/or obviate the afore-described disadvantages of the conventional electromagnetic lock devices.

SUMMARY OF THE INVENTION

The primary objective of the present invention is to provide an electric lock device including a deadbolt or tongue lockable with an electromagnetic mechanism which is adjustable and operatable when the electromagnetic mechanism is either switched on or switched off.

In accordance with one aspect of the invention, there is provided a lock device comprising a housing including a chamber formed therein, and including a front wall member having an opening formed therein, a tongue slidably engaging with the opening of the housing and extendible out of the housing, an anchoring device slidably disposed in the chamber of the housing and including a first anchoring member for selectively aligning with the tongue, and including a second anchoring member for selectively aligning with the tongue, and including a compartment formed between the first and the second anchoring members, and a moving device for moving the anchoring device relative to the housing to selectively align either the first anchoring member or the second anchoring member with the tongue and for preventing the tongue from being engaged into the compartment of the anchoring device.

The moving device includes an electromagnetic mechanism coupled to the anchoring device for moving the anchoring device relative to the housing to selectively align either the first anchoring member or the second anchoring member with the tongue. The electromagnetic mechanism includes a core extended out of the electromagnetic mechanism and coupled to the anchoring device and moved in concert with the anchoring device.

The moving device includes a casing secured to the electromagnetic mechanism, and at least one fastener selectively secures the casing and the electromagnetic mechanism to the housing at a first position where the first anchoring member is selectively aligned with the tongue, and selectively secures the casing and the electromagnetic mechanism to the housing at a second position where the second anchoring member is selectively aligned with the tongue.

The first anchoring member is aligned with the tongue when the electromagnetic mechanism is switched on for preventing the tongue from being engaged into the compartment of the anchoring device, and the first anchoring member is offset from the tongue when the electromagnetic mechanism is switched off.

The second anchoring member is aligned with the tongue when the electromagnetic mechanism is switched off for preventing the tongue from being engaged into the compartment of the anchoring device, and the second anchoring member is offset from the tongue when the electromagnetic mechanism is switched on.

The housing includes a rear wall member having a first orifice and a second orifice formed therein for selectively engaging with the fastener and for selectively securing the casing and the electromagnetic mechanism to the housing either at the first position or at the second position.

The housing includes an oblong hole formed therein for selectively engaging with the fastener and for selectively securing the casing and the electromagnetic mechanism to the housing either at the first position or at the second position.

The housing includes a spring biasing member disposed in the chamber of the housing and engaged with the tongue for biasing and forcing the tongue to move out through the opening of the housing.

The tongue includes an inner portion slidably received in the chamber of the housing, and includes a slot formed in the inner portion of the tongue, and the spring biasing member includes a leg engaged into the slot of the inner portion of the tongue.

The anchoring device includes a groove formed in the second anchoring member for slidably receiving the leg of the spring biasing member. The anchoring device includes a coupler securing the first and the second anchoring members together and for forming the compartment between the first and the second anchoring members.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
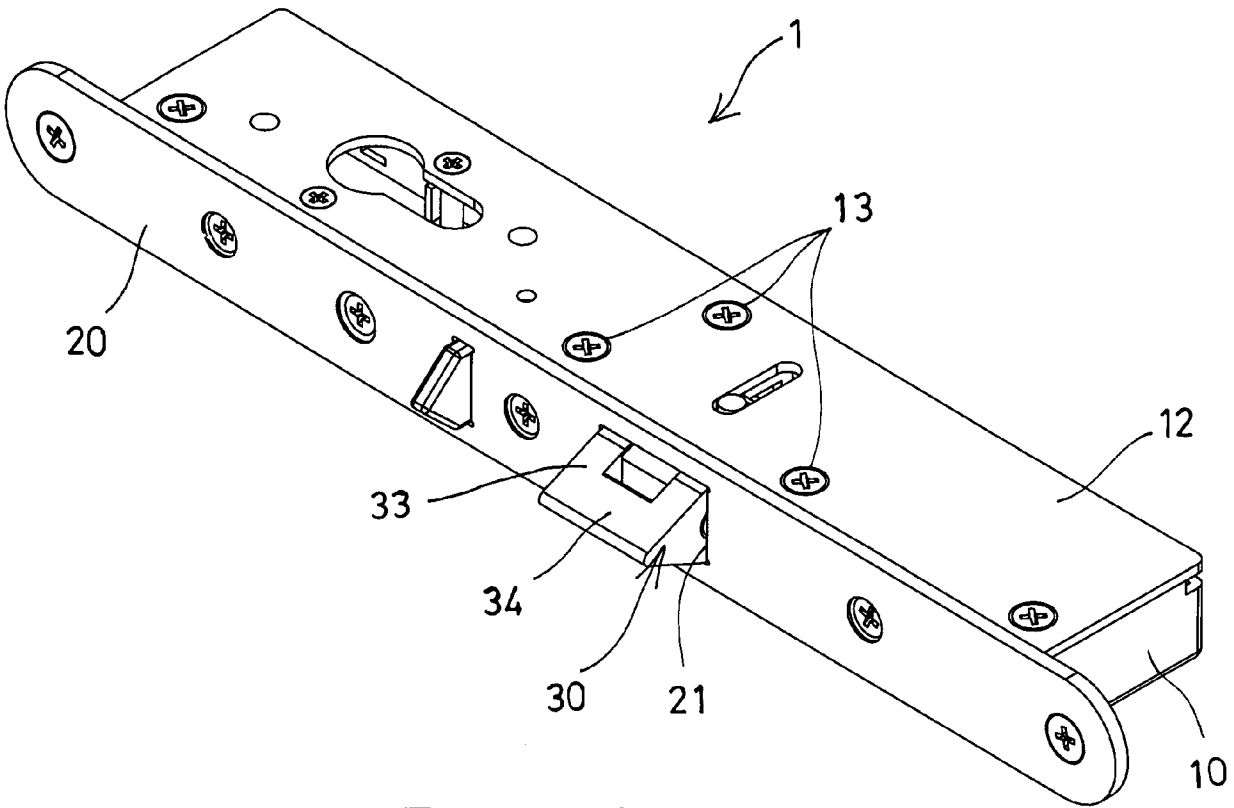
FIG. 1 is a perspective view of an electric lock device in accordance with the present invention.
Figure 2:
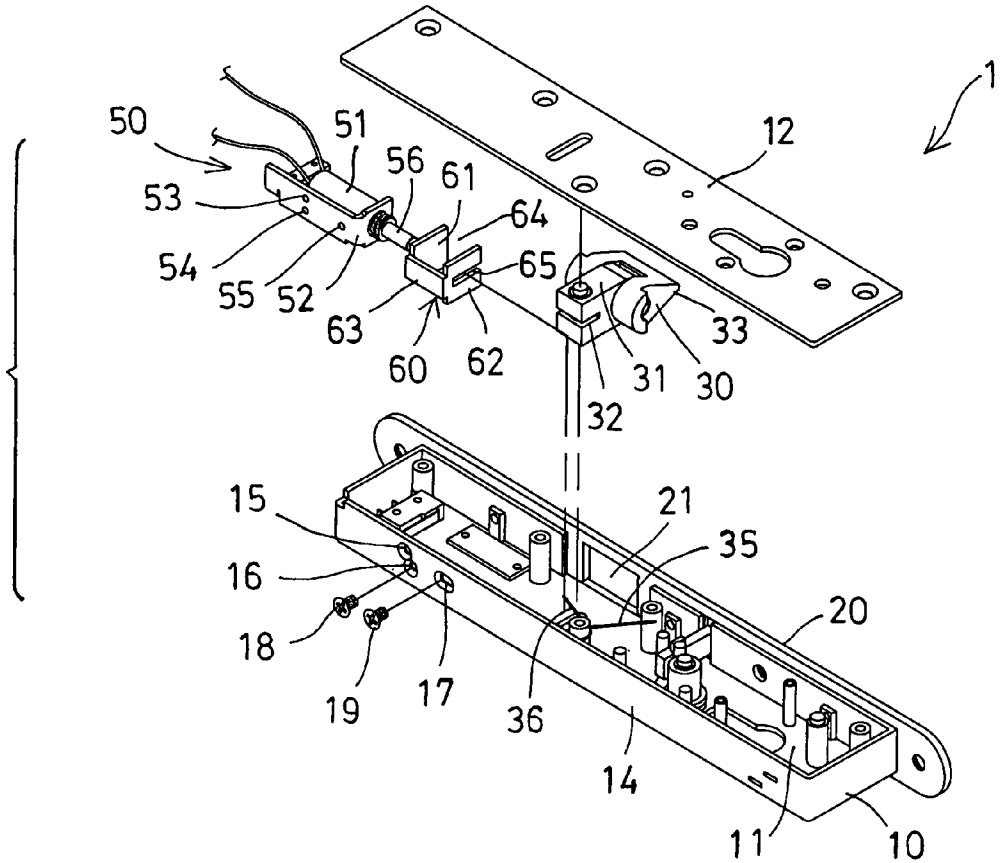
FIG. 2 is a partial exploded view of the electric lock device.

Referring to the drawings, and initially to FIGS. 1-5, an electric lock device 1 in accordance with the present invention comprises a housing 10 including a chamber 11 formed therein for receiving various parts or elements, and including a cover 12 secured on top of the housing 10 with such as latches or fasteners 13 for closing the chamber 11 of the housing 10, and including a side or rear wall member 14 having two orifices 15, 16 and an oblong hole 17 formed therein for selectively receiving or engaging with fasteners 18, 19, and including a side or front wall member 20 having an opening 21 formed therein for slidably receiving or engaging with a deadbolt or tongue 30.

Figure 9:
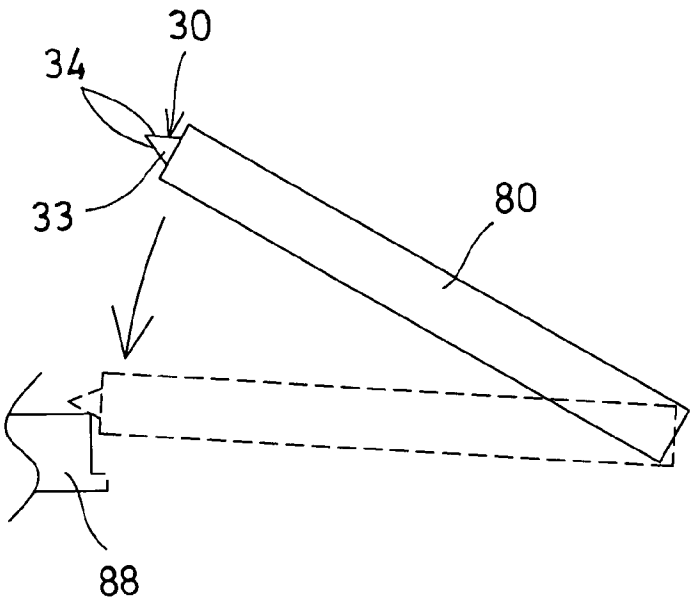
FIGS. 8, 9 are partial top plan schematic views illustrating the arrangements of the electric lock device.
Figure 8:
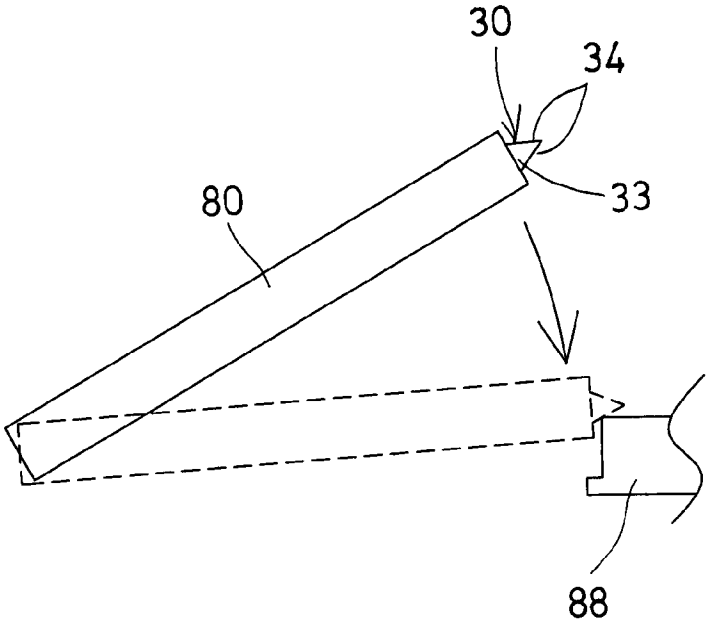

The tongue 30 includes a tail or inner portion 31 slidably received in the chamber 11 of the housing 10, and includes a slot 32 formed in the inner portion 31 of the tongue 30, and includes an actuating outer tongue segment 33 having two inclined surfaces 34 for engaging with the door panels or the keepers of the door jambs or the door frames. For example, as shown in FIGS. 8 and 9, the tongue 30 of the housing 10 and/or of the electric lock device 1 may be attached or engaged into a door panel 80 and disposed or arranged on either the inner side or the outer side of the door jambs or the door frames 88 for selectively engaging with the keepers of the door jambs or the door frames 88.

As shown in FIGS. 2-3 and 5-6, a spring biasing means or member 35 may be attached or disposed in the chamber 11 of the housing 10, and includes one leg 36 attached or engaged into the slot 32 of the inner portion 31 of the tongue 30 for engaging with the tongue 30 and for biasing or forcing the tongue 30 to move out through the opening 21 of the front wall member 20 of the housing 10 and to engage with the keepers of the door jambs or the door frames 88. The tongue 30 may be selectively moved into the opening 21 of the front wall member 20 of the housing 10 against the spring biasing member 35 manually with a key or handle (not shown) or the like or electrically with an electromagnetic mechanism (not shown) or the like.

An operating or locking or moving means or device 50 includes an electromagnetic mechanism 51 attached or disposed in a casing 52 which includes three holes 53, 54, 55 formed therein for selectively aligning with the orifices 15, 16 and the oblong hole 17 of the rear wall member 14 of the housing 10 for selectively engaging with the fasteners 18, 19. For example, as shown in FIG. 3, when the fastener 18 is engaged through one of the orifices 15 of the housing 10, the casing 52 and the electromagnetic mechanism 51 may be secured to the housing 10 at a position located farther away from the tongue 30; and the casing 52 and the electromagnetic mechanism 51 may be secured to the housing 10 at another position located closer to the tongue 30 (FIG. 6) when the fastener 18 is engaged through the other orifice 16 of the housing 10.

The moving means or device 50 includes a core 56 slidably engaged or extended out of the electromagnetic mechanism 51 and/or the casing 52 and actuatable or movable or operatable with the core 56 to move either toward or away from the tongue 30. An anchoring device 60 is disposed in the chamber 11 of the housing 10 and attached or secured or coupled to the core 56 of the moving means or device 50 and moved in concert with the core 56, and includes two stops or anchoring members 61, 62 spaced from each other and secured together with a coupler 63 for forming a space or compartment 64 between the anchoring members 61, 62, and includes a groove 65 formed in one of the anchoring members 62 for selectively and slidably receiving or engaging with the leg 36 of the spring biasing member 35 (FIGS. 3, 6).

Figure 3:
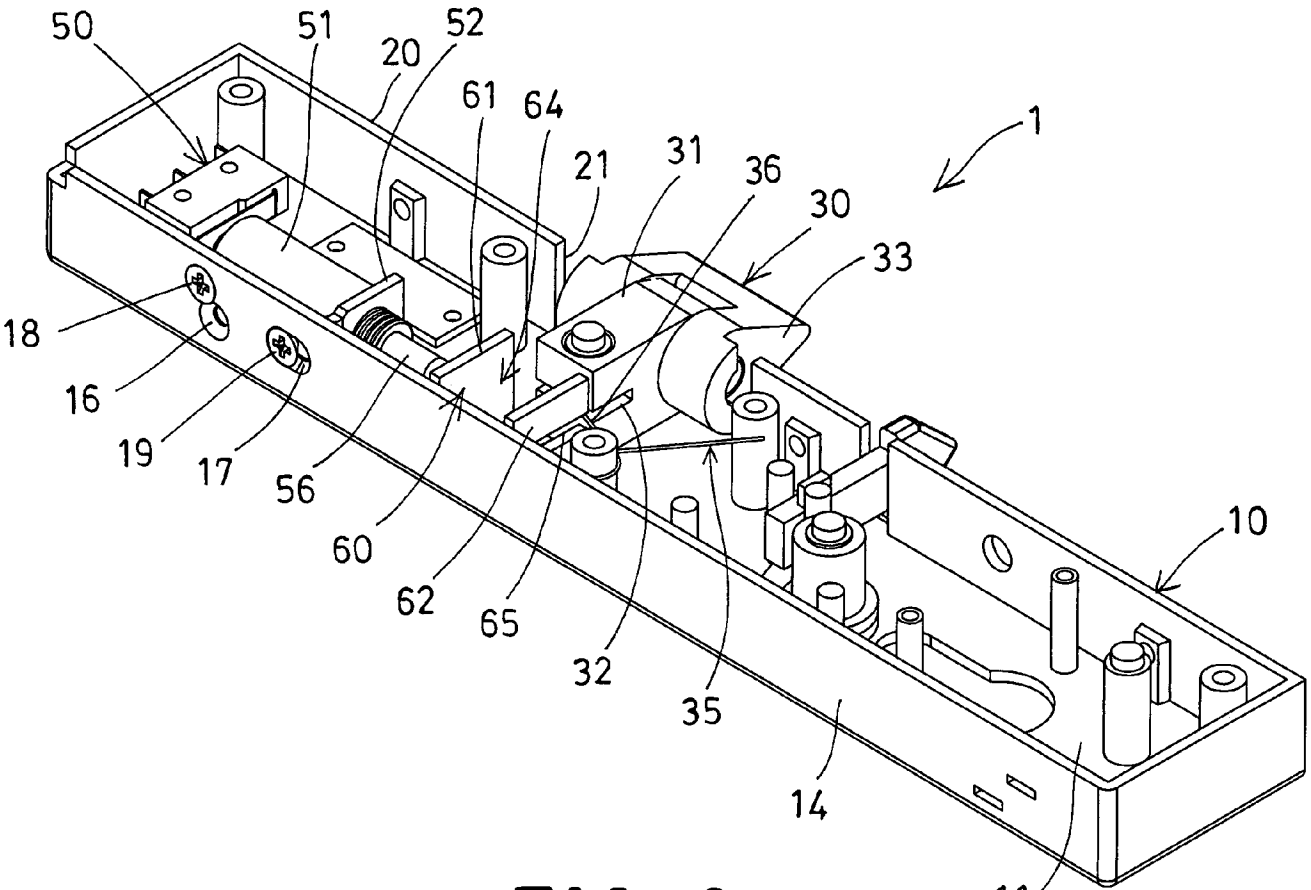
FIG. 3 is a partial perspective view of the electric lock device in which a cover of the electric lock device has been removed for showing an inner structure of the electric lock device.
Figure 4:
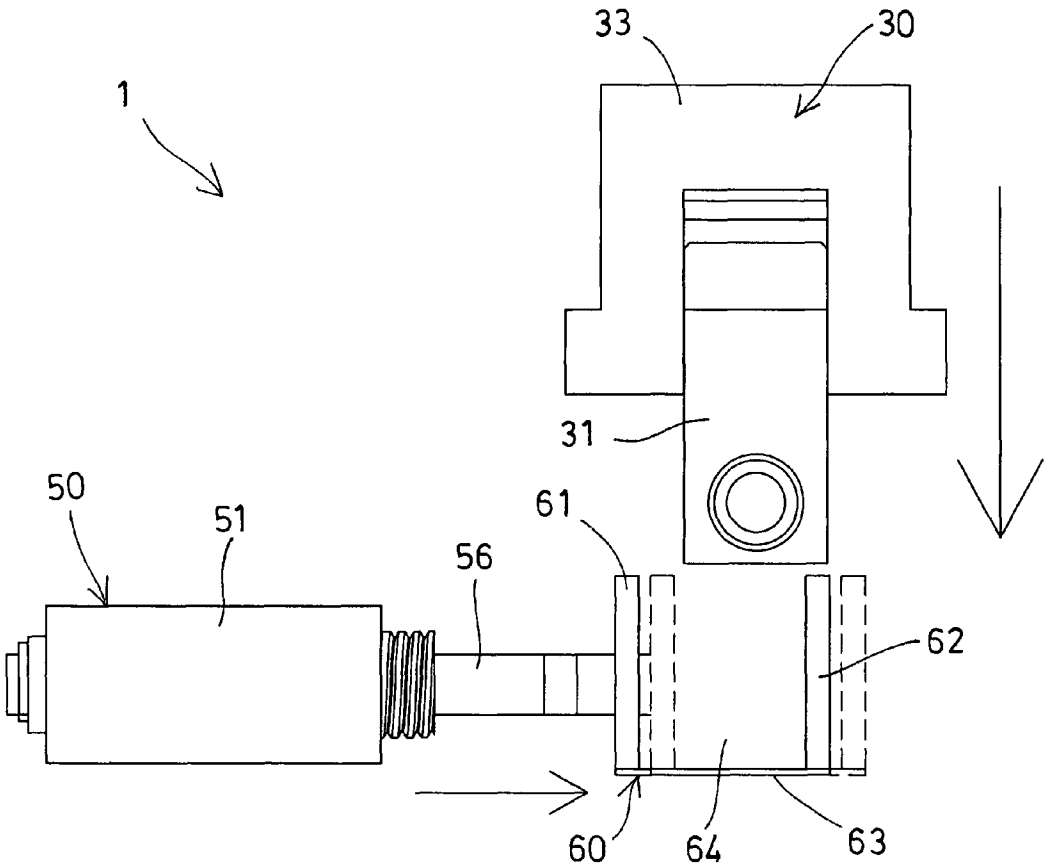
FIG. 4 is a partial top plan schematic view illustrating the operation of the electric lock device.

In operation, as shown in FIGS. 3 and 4, when the fastener 18 is engaged through one of the orifices 15 of the housing 10 and when the other fastener 19 is slidably engaged through the oblong hole 17 of the housing 10, the casing 52 and the electromagnetic mechanism 51 may be secured to the housing 10 at a position located farther away from the tongue 30, at this moment, the anchoring member 61 may be offset from the inner portion 31 of the tongue 30, and the other anchoring member 62 may be aligned with the inner portion 31 of the tongue 30 when the electromagnetic mechanism 51 is switched off for preventing the inner portion 31 of the tongue 30 from being engaged into the compartment 64 of the anchoring device 60.

Figure 5:
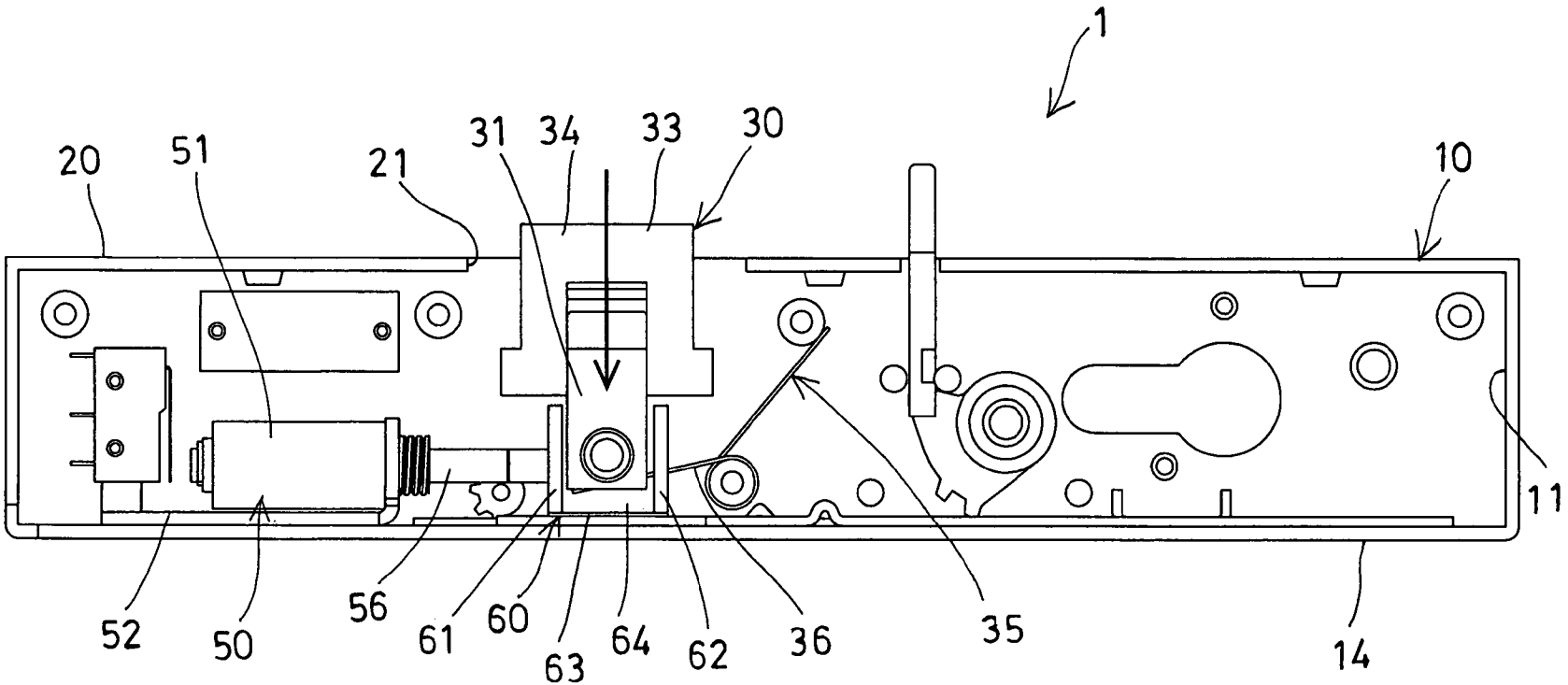
FIG. 5 is a partial top plan schematic view of the electric lock device in which the outer cover of the electric lock device has also been removed for showing the inner structure of the electric lock device.

When the electromagnetic mechanism 51 is energized or switched on to move the anchoring device 60 away from the electromagnetic mechanism 51, the other anchoring member 62 may be moved and offset or disengaged from the inner portion 31 of the tongue 30, and the inner portion 31 of the tongue 30 may be aligned with the compartment 64 of the anchoring device 60, as shown in dotted lines in FIG. 4, for allowing the inner portion 31 of the tongue 30 to be selectively engaged into the compartment 64 of the anchoring device 60 (FIG. 5).

Figure 6:
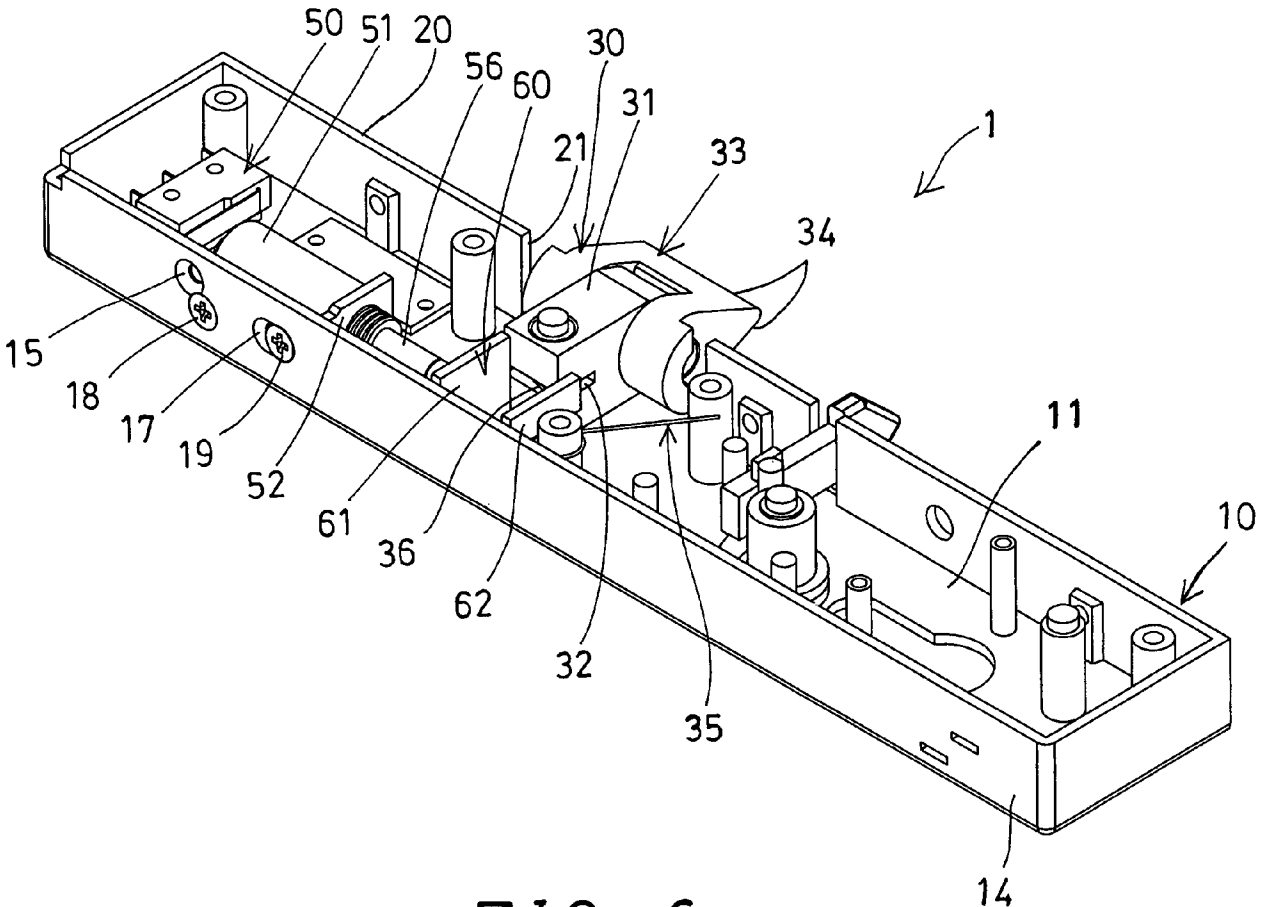
FIG. 6 is another partial perspective view similar to FIG. 3, illustrating the other arrangement of the electric lock device.
Figure 7:
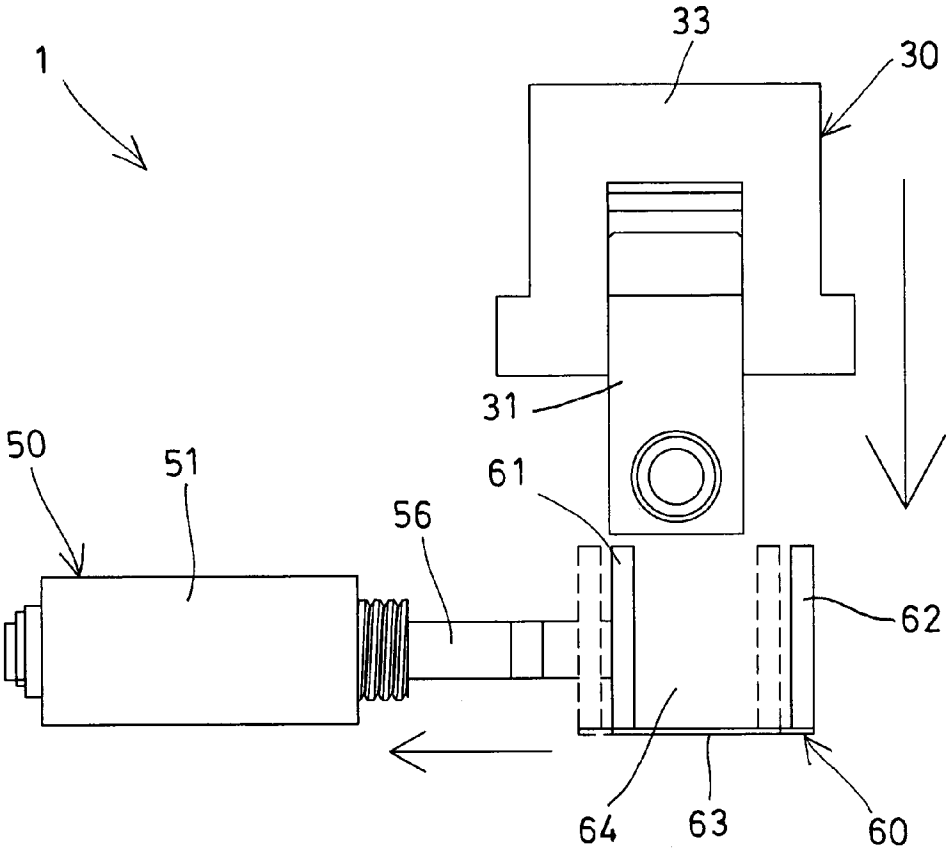
FIG. 7 is a partial top plan schematic view illustrating the operation of the electric lock device as shown in FIG. 6.

As shown in FIGS. 6 and 7, when the fastener 18 is engaged through the other orifice 16 of the housing 10 and when the other fastener 19 is slidably engaged through the oblong hole 17 of the housing 10, the casing 52 and the electromagnetic mechanism 51 may be secured to the housing 10 at another position located closer to the tongue 30, and at this moment, the other anchoring member 62 may be offset from the inner portion 31 of the tongue 30, and the anchoring member 61 may be aligned with the inner portion 31 of the tongue 30 when the electromagnetic mechanism 51 is normally switched on or energized for preventing the inner portion 31 of the tongue 30 from being engaged into the compartment 64 of the anchoring device 60.

When the electromagnetic mechanism 51 is switched off, the anchoring device 60 may be moved toward the electromagnetic mechanism 51 by the electromagnetic mechanism 51, the anchoring member 61 may be moved and offset or disengaged from the inner portion 31 of the tongue 30, and the inner portion 31 of the tongue 30 may be aligned with the compartment 64 of the anchoring device 60, as shown in dotted lines in FIG. 7, for allowing the inner portion 31 of the tongue 30 to be selectively engaged into the compartment 64 of the anchoring device 60 (FIG. 5).

It is to be noted that the inner portion 31 of the tongue 30 may be locked and may be prevented from being engaged into the compartment 64 of the anchoring device 60 when the electromagnetic mechanism 51 is energized or normally switched on and when the anchoring member 61 is aligned with the inner portion 31 of the tongue 30 (FIGS. 6, 7) and when the casing 52 and the electromagnetic mechanism 51 are secured to the housing 10 at the position located closer to the tongue 30. Alternatively, as shown in FIGS. 3 and 4, the inner portion 31 of the tongue 30 may be locked and may be prevented from being engaged into the compartment 64 of the anchoring device 60 when the electromagnetic mechanism 51 is switched off and when the other anchoring member 62 is aligned with the inner portion 31 of the tongue 30 and when the casing 52 and the electromagnetic mechanism 51 are secured to the housing 10 at the position located farther away from the tongue 30.

Accordingly, the electric lock device in accordance with the present invention includes a deadbolt or tongue lockable with an electromagnetic mechanism which is adjustable and operatable when the electromagnetic mechanism is either switched on or switched off.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A lock device comprising:

a housing including a chamber formed therein, and including a front wall member having an opening formed therein, and a back wall member having first and second screw holes and an elongated screw slot therein, wherein the first screw hole is located farther from the elongated screw slot than the second screw hole;

first and second fasteners;

a tongue slidably moving between a locked position, extending from the opening, and an unlocked position, retracted into the housing;

a manual actuator mechanism operatively connected to said tongue to move it between the locked and unlocked positions;

an anchoring device slidably disposed in said chamber of said housing and including a first anchoring member, a second anchoring member and a compartment formed between said first and said second anchoring members, and moving means operatively connected to said anchoring device for moving said anchoring device relative to said housing;

wherein, when said first fastener is placed on the first screw hole and said second fastener is placed on said elongated screw slot, one of the first and second anchoring members will be aligned with said tongue while the other one would be misaligned with said tongue, so that when said moving means is turned on, the anchoring device will move, so that said compartment is moved to be aligned with said tongue allowing the lock device to be unlocked;

wherein, when said first fastener is placed on the second screw hole and said second fastener is placed on said elongated screw slot, one of the first and second anchoring members will be aligned with said tongue while the other one would be misaligned with said tongue, so that when said moving means is turned off, the anchoring device will move, so that said compartment is moved to be aligned with said tongue allowing the lock device to be unlocked.

2. The lock device as claimed in claim 1, wherein said moving means includes an electromagnetic mechanism coupled to said anchoring device for moving said anchoring device relative to said housing to selectively align either said first anchoring member or said second anchoring member with said tongue.

3. The lock device as claimed in claim 2, wherein said electromagnetic mechanism includes a core extended out of said electromagnetic mechanism and coupled to said anchoring device.

4. The lock device as claimed in claim 1, wherein said housing includes a spring biasing member disposed in said chamber of said housing and engaged with said tongue for biasing and forcing said tongue to move out through said opening of said housing.

5. The lock device as claimed in claim 4, wherein said tongue includes an inner portion slidably received in said chamber of said housing, and includes a slot formed in said inner portion of said tongue, and said spring biasing member includes a leg engaged into said slot of said inner portion of said tongue.

6. The lock device as claimed in claim 5, wherein said anchoring device includes a groove formed in said second anchoring member for slidably receiving said leg of said spring biasing member.

7. The lock device as claimed in claim 1, wherein said anchoring device includes a coupler securing said first and said second anchoring members together.

* * * * *